US005112366A

United States Patent [19]

Liu

[11] Patent Number: 5,112,366

[45] Date of Patent: May 12, 1992

[54] SLAG DEPOSITION DETECTION

[75] Inventor: Chih-hsiung F. Liu, Houston, Tex.

[73] Assignee: Shell Oil Company, Houston, Tex.

[21] Appl. No.: 628,822

[22] Filed: Dec. 17, 1990

[51] Int. Cl.[5] ..... C10J 3/46; C10J 3/82; C10J 3/86

[52] U.S. Cl. ..... 48/210; 48/206; 48/DIG. 2; 252/373

[58] Field of Search ..... 48/197 R, 202, 203, 48/206, 210, DIG. 2, DIG. 10; 252/373; 110/165 R, 165 A; 122/7 R; 55/80, 269

[56] References Cited

U.S. PATENT DOCUMENTS

| | | | |
|---|---|---|---|
| 4,478,608 | 10/1989 | Darling et al. | 48/210 |
| 4,851,013 | 7/1989 | Luke | 48/203 |
| 4,874,397 | 10/1989 | Heit | 48/210 |
| 4,889,657 | 12/1989 | Jahnke | 252/373 |
| 4,897,090 | 1/1990 | Liu et al. | 48/210 |
| 4,963,163 | 10/1990 | Clomburg et al. | 48/210 |

*Primary Examiner*—Peter Kratz

[57] ABSTRACT

A method for determining blockage of a coal gasification process quench zone or heat exchanger by monitoring changes in the heat transfer values.

10 Claims, 1 Drawing Sheet

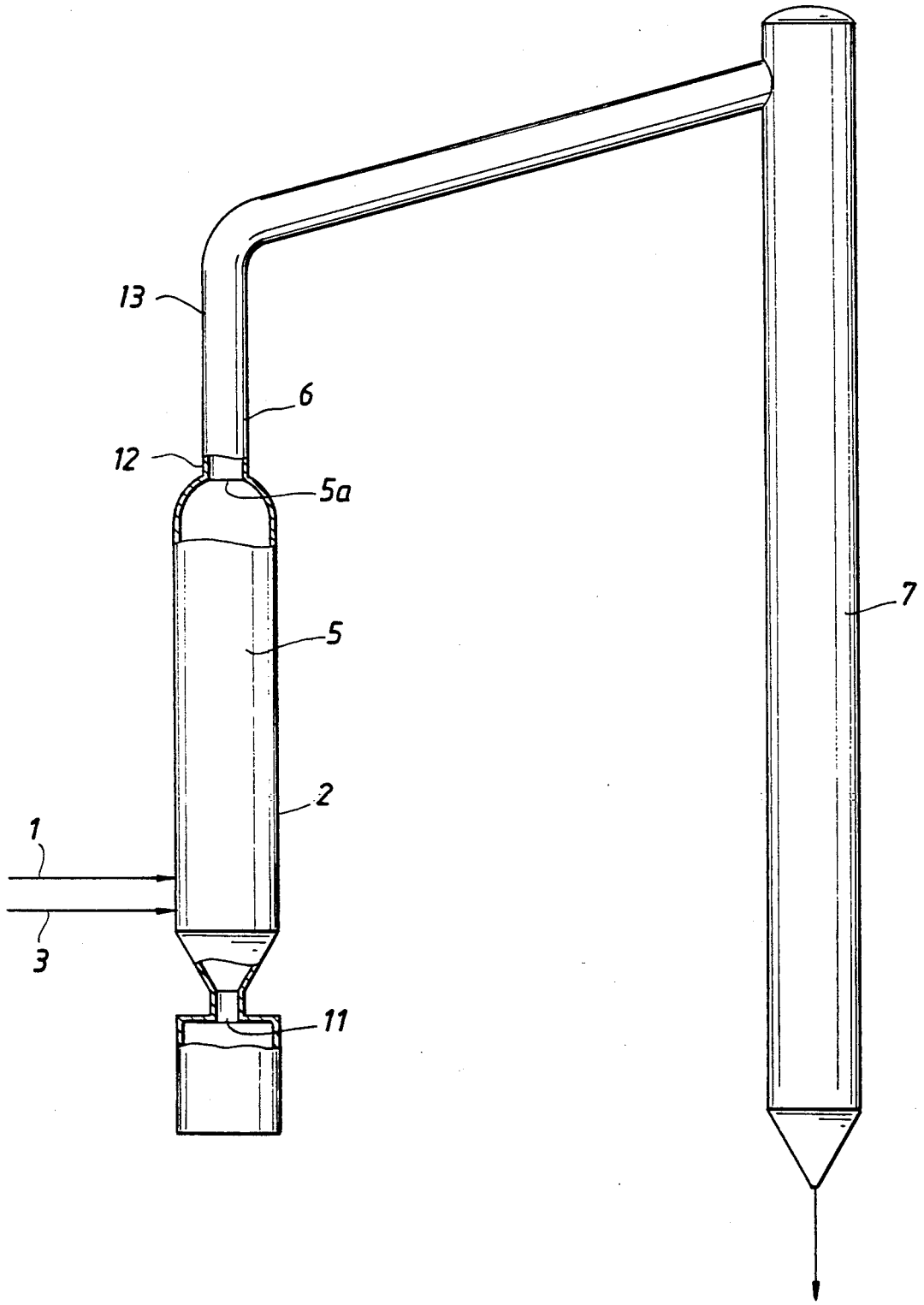
13
6
12
5a
7
5
2
1
3
11

SLAG DEPOSITION DETECTION

BACKGROUND OF THE INVENTION

This invention relates to the monitoring of a process for the partial oxidation of a carbon-containing fuel, particularly coal, by an oxygen-containing gas in a reactor under high pressures and temperatures. In a preferred form, it relates to a process for monitoring a gasifier from which the product gas is removed at the top of the gasifier and the formation of solid deposits at or near the exit thereof and in proximate heat exchange equipment may be encountered.

Many carbon-containing fuels are of mineral origin, and often contain, in addition to carbon and hydrogen, varying quantities of inorganic incombustible material. The latter material is a by-product of the process of combustion or oxidation, and, depending on characteristics such as density and size of the particular particle, and the reactor configuration and conditions, may undergo a rough separation therein into particles called "flyash" (lighter) and "slag" (denser). The flyash particles may be removed with the combustion gas or product synthesis gas through a zone or conduit where the gas and particles undergo heat exchange, while the denser materials may collect as a molten slag in the hearth of the reactor and are discharged downward through an outlet or orifice in the hearth, in some cases, into a water bath. In some instances, product gas, slag, and flyash are removed together from one outlet, but may undergo a similar later separation.

A real concern in processes, particularly where product gas is removed "overhead" through a vertically disposed conduit or heat exchange zone, is that the slag separation will not be complete and "stalagmite" deposits will tend to grow or creep outward or upward from slag depositing at the outlet of the gasification zone. Blockage of the gasifier outlet and the entrance and initial segment of the quench zone by such mechanism represents a potentially catastrophic situation and requires shutdown of the operation, an obviously unsatisfactory circumstance. Accordingly, to prevent such occurrences, regular monitoring of the units is practiced, and techniques, such as rapping, are employed to limit or release deposits. The invention is directed to an improved method of monitoring gasifier and heat exchange zone stalagmite deposit formation during full operation of the process.

SUMMARY OF THE INVENTION

The invention proceeds from an analysis of heat transfer phenomena observed during operation of the gasification zone-heat exchange system. In order to remove the tremendous heat generated by the partial oxidation, the gasification zone, quench zone, and related heat exchange zone are provided with suitable heat exchange structure. For example, in one integrated scheme, the walls of the aforementioned zones are constructed at least partly, or are in contact with, heat exchange tubes which remove heat by the circulation of steam therethrough. Analysis of heat transfer rate values at suitable loci in the heat transfer system reveals distinct patterns of operation which may be used to monitor the formation of stalagmites. More particularly, if heat transfer is monitored at a site near the outlet of the gasifier, and heat transfer at a site "downstream" from the gasifier is concurrently monitored, a comparison of the changes in the heat transfer at the two sites over time reveal a pattern which can be used to monitor the formation of stalagmites.

Accordingly, in one embodiment, the invention relates to a procedure or process for monitoring slag deposit formation on heat exchange surfaces at the outlet of a gasifier or gasification zone and heat exchange surfaces proximate thereto, and heat exchange surfaces at the outlet of the gasification zone in the heat exchange zone in flow communication with the gasification zone during operation of the process comprising determining the heat transfer rate value at a first locus in said heat exchange zone near the outlet of said gasifier, concurrently determining the heat transfer rate value at a second locus in said quench zone, said second locus being further displaced in said heat exchange zone from said gasifier than the first locus; and comparing the values obtained concurrently with each other to determine correlated slag deposition events. Determinations of heat transfer rate values may be made continually or periodically, and the comparison made continually (if the determinations are), or periodically, as desired. As used herein, the term "locus" refers to a general physical site, which may have one or more sensing devices located there to provide a desired reading or measurement. Also, the term "correlated slag deposition events" refers to related incidents of slag deposition or shedding which can be inferred from observed heat transfer rate value changes and their relationship to each other. In normal circumstances, a pattern or profile of the heat transfer rate values at the respective loci is established on start-up by the recording of heat transfer rate values before any substantial blockage can occur. Based on the observed heat transfer rate values pattern on beginning the operation of the gasifier with clean heat exchange surfaces, observed complementary changes or deviations in heat transfer at the different loci can be interpreted to indicate the formation and growth or shedding of slag deposits at the outlet of the gasifier or in the heat exchange zone communicating with the gasifier. For example, a continued relatively low heat transfer rate at the first locus accompanied by significantly increased heat transfer rate at the second locus in light of the baseline values suggests growth of a stalagmite along the heat exchange surface. Again, a sudden change in heat transfer rates of the two loci may suggest a shedding event.

As will be understood by those skilled in the art, the heat transfer rate at the respective loci can be determined in more than one way. For example, temperature can be measured by probes, and the heat transfer rate calculated. Preferably, the heat transfer rate is observed only indirectly, the heat transfer being monitored by steam density measurements (taken by steam densitometers positioned in the heat exchange tubes at the respective loci). In this case, an inverse relationship will apply, i.e., an increase in steam density at a given locus means deteriorated heat transfer, and vice versa.

DETAILED DESCRIPTION OF THE INVENTION

The partial oxidation or gasification of coal to produce synthesis gas, which is substantially carbon monoxide and hydrogen, and particulate flyash, is well known, and a survey of known processes is given in *The Chemistry of Coal,* 2nd Supplementary Volume, NAS-NRC Committee on Chemistry of Coal (1981). In general, the gasification is carried out by partially combusting the coal with a limited volume of oxygen at a temperature normally between 800° C. and 2000° C. If a temperature of between 1050° C. and 2000° C. is employed, the product gas will contain very small amounts of gaseous side products such as tars, phenols and condensable hydrocarbons. Suitable coals include lignite, bituminous coal, sub-bituminous coal, anthracite coal, and brown coal. Lignites and bituminous coals are preferred. In order to achieve a more rapid and complete gasification, initial pulverization of the coal is preferred. Particle size is preferably selected so that 70% of the solid coal feed can pass a 200-mesh sieve. The gasification is preferably carried out in the presence of oxygen and steam, the purity of the oxygen preferably being at least 90% by volume, nitrogen, carbon dioxide and argon being permissible as impurities. If the water content of the coal is too high, the coal should be dried before use. The atmosphere will be maintained reducing by the regulation of the weight ratio of the oxygen to moisture and ash free coal in the range of 0.6 to 1.0, preferably 0.8 to 0.9. The specific details of the procedures employed form no part of the invention, but those described in U.S. Pat. Nos. 4,350,103 and 4,458,607, both incorporated herein by reference, may be employed. Although, in general, it is preferred that the ratio between oxygen and steam be selected so that from 0 to 1.0 parts by volume of steam is present per part by volume of oxygen, the invention is applicable to processes having substantially different ratios of oxygen to steam. The oxygen used is preferably heated before being contacted with the coal, preferably to a temperature of from about 200° C. to 500° C.

The high temperature at which the gasification is carried out is obtained by reacting the coal with oxygen and steam in a reactor at high velocity. A preferred linear velocity of injection is from 10 to 100 meters per second, although higher or lower velocities may be employed. The pressure at which the gasification can be effected may vary between wide limits, preferably being from 1 to 200 bar. Residence times may vary widely; common residence times of from 0.2 to 20 seconds are described, with residence times of from 0.5 to 15 seconds being preferred.

After the starting materials have been converted, the reaction product, which comprises hydrogen, carbon monoxide, carbon dioxide, and water, as well as the aforementioned impurities, is removed from the reactor. This gas, which normally has a temperature between 1050° C. and 1800° C., contains the impurities mentioned and flyash, including carbon-containing solids. In order to permit removal of these materials and impurities from the gas, the reaction product stream is first quenched and cooled. A variety of elaborate techniques have been developed for quenching and cooling the gaseous stream, the techniques in the quench zone and primary heat exchange zone in general being characterized by use of a quench gas and a boiler in which steam is generated with the aid of the waste heat. In general, as indicated, the product gas is passed through an outlet at or near the top of the gasifier and into a quench zone. The quench zone is preferably a conduit which is cooled by external heat exchange, and means will be provided in the zone, such as cooling gas jets, for quenching of the product gas.

The quenched gas is then subjected to a variety of purification techniques to produce a product gas, commonly called synthesis gas, which has good fuel value as well as being suitable as a feedstock for various processes.

One advantage of the present invention is the capability of controlling the blockage of the quench zone, thus extending the time periods between shutdown of the gasifier. In response to an indication of partial blockage, the partial oxidation process conditions may be changed or varied, such as the oxygen to coal ratio. For example, the oxygen to coal ratio may be decreased (or increased) depending on other factors. Additionally, the flexibility of operating the process under various conditions, such as a range of pressures, temperatures, and types of coal which characteristically produce different amounts of flyash is achieved.

Illustration

The following illustration is given with reference to the drawing. The figure illustrates schematically the use of the invention in one type of gasifier for the gasification of coal. All values are merely exemplary or calculated.

Accordingly, pulverulent coal is passed via line 1 into the burners of gasifier 2, oxygen being supplied via line 3. The burners are operated under partial oxidation conditions in enclosed reaction chamber 5 to produce synthesis gas, flyslag or flyash, and slag. Synthesis gas and flyash leave the reaction space 5 and pass from the upper portion of the gasifier to a quench conduit 6 where the gas and flyash are quenched, the flyash becoming solidified. The gas and flyash particles are then passed for further heat exchange in heat exchanger 7 and then passed to solids removal zones and sour gas removal zones (not shown). Concomitantly, slag produced falls to the lower portion of chamber 5 and is allowed to flow by gravity through a slag discharge opening or tap 11.

As noted, the walls and conduits of the process must not be allowed to plug or become blocked. However, slag may become deposited at or near the outlet **5*a* of the gasifier and "grow" into quench zone 6. Periodic rapping tends to dislodge the deposits, and some deposits are removed by natural forces, but a gradual buildup may occur. According to the invention, suitable sensing devices (steam density measuring devices) are located in the tubes forming the walls of quench conduit 6 at 12 and 13, respectively, an appropriate distance apart, e.g., 2 to 25 or 30 feet. The steam density measurements are observed continually, or periodically, say every 30 seconds, and are compared with readings taken on start-up of the gasifier. A "sawtooth" pattern should be produced, the heat transfer rate and steam density being greater and lower, respectively, at a given locus after any shedding incident and gradually decreasing until the next incident. As experience is obtained with operation of the system, a baseline can be obtained for future comparison. For example, a sudden excursion in steam density relative to the baseline at the second locus 13 with a corresponding change in steam density at the first locus 12** may indicate a shedding event. Moreover, as deposits increase in the area of the first locus, the relative steam density measurements at the second site will remain high while the measurements at the first locus will remain low. As the deposit becomes larger, reaching a critical stage, the magnitude of the swing of the steam density measurement at the second locus becomes quite great, indicating the necessity for remedial action or shutdown. By identifying the early existence of a partial blockage, operating conditions may be changed to prevent or inhibit further deposition or even stimulate the removal of some or all of the blockage. Also, the monitoring technique of the invention may allow identification of conditions which lead to the origination of the partial blockage, so that those conditions may be avoided in subsequent operations.

What is claimed is:

1. A process for monitoring slag deposit formation during a process for the gasification of coal on heat exchange surfaces at the outlet of a gasification zone and heat exchange surfaces proximate thereto, and heat exchange surfaces at or near the outlet of the gasification zone in a heat exchange zone in flow communication with the gasification zone comprising feeding coal and oxygen to the gasification zone for partial oxidation of the coal therein, determining the heat transfer rate value at a first locus in said heat exchange zone near the outlet of said gasification zone, concurrently determining the heat transfer rate value at a second locus in said heat exchange zone, said second locus being further displaced in said heat exchange zone from said gasification zone than the first locus; and comparing the values obtained concurrently with each other to determine correlated slag deposition events.

2. The process of claim 1 wherein the outlet is in the upper portion of the gasification zone.

3. The process of claim 2 wherein, in response to prolonged reduced heat transfer rate values at the first locus with concurrent large increase of the heat transfer rate values at the second locus, the process for the partial oxidation of coal in the gasification zone is discontinued.

4. A process for monitoring slag deposit formation during a process for the gasification of coal on heat exchange surfaces at the outlet of a gasification zone and heat exchange surfaces proximate thereto, and heat exchange surfaces at the outlet of the gasification zone in a heat exchange zone in flow communication with the gasification zone operation comprising feeding coal and oxygen to the gasification zone for partial oxidation of the coal therein, determining the steam density value at a first locus in said heat exchange zone near the outlet of said gasification zone, concurrently determining the steam density value at a second locus in said heat exchange zone, said second locus being further displaced in said heat exchange zone from said gasification zone than the first locus; and comparing the steam density values obtained concurrently with each other to determine correlated slag deposition events.

5. The process of claim 4 wherein, in response to prolonged increased steam density values at the first locus with concurrent large decrease of the steam density values at the second locus, the process for the partial oxidation of coal in the gasification zone is discontinued.

6. A process for the gasification of coal comprising feeding particulate coal and oxygen to a gasifier having an enclosed reaction chamber under conditions to oxidize the coal and produce a product stream comprising synthesis gas and flyash, passing the product stream from the gasifier through an outlet to a heat exchange zone, and recovering synthesis gas;

monitoring slag deposit formation on heat exchange surfaces at the outlet of said gasifier and heat exchange surfaces proximate thereto, and heat exchange surfaces in the heat exchange zone at or near the outlet of the gasifier in flow communication with the gasifier during operation by determining the heat transfer rate value at a first locus in said heat exchange zone near the outlet of said gasifier, concurrently determining the heat transfer rate value at a second locus in said heat exchange zone, said second locus being further displaced in said heat exchange zone from said gasifier than the first locus; and comparing the values obtained concurrently with each other to determine correlated slag deposition events.

7. A process for the gasification of coal comprising feeding particulate coal and oxygen to a gasifier having an enclosed reaction chamber under conditions to oxidize the coal and produce a product stream comprising synthesis gas and flyash, passing the product stream from the gasifier through an outlet to a heat exchange zone, and recovering synthesis gas;

monitoring slag deposit formation on heat exchange surfaces at the outlet of said gasifier and heat exchange surfaces proximate thereto, and heat exchange surfaces at or near the outlet of the gasifier in the heat exchange zone in flow communication with the gasifier during operation by determining the steam density at a first locus in said heat exchange zone near the outlet of said gasifier, concurrently determining the steam density at a second locus in said heat exchange zone, said second locus being further displaced in said heat exchange zone from said gasifier than the first locus; and comparing the values obtained concurrently with each other to determine correlated slag deposition events.

8. A process for monitoring slag deposit formation during a process for the gasification of coal on heat exchange surfaces at the outlet of a gasification zone and heat exchange surfaces proximate thereto, and heat exchange surfaces at or near the outlet of the gasification zone in a heat exchange zone in flow communication with the gasification zone during operation comprising feeding coal and oxygen to the gasification zone for partial oxidation of the coal therein, establishing a pattern or profile of the heat transfer rate values at a first locus in said heat exchange zone near the outlet of said gasification zone and at a second locus in said heat exchange zone, said second locus being further displaced in said heat exchange zone from said gasification zone than the first locus;

determining the heat transfer rate value at said first locus in said heat exchange zone near the outlet of said gasification zone, concurrently determining the heat transfer rate value at said second locus in said heat exchange zone; and comparing the values obtained concurrently with each other to determine correlated slag deposition events.

9. A process for monitoring slag deposit formation during a process for the gasification of coal on heat exchange surfaces at the outlet of a gasification zone and heat exchange surfaces proximate thereto, and heat exchange surfaces at or near the outlet of the gasification zone in a heat exchange zone in flow communication with the gasification zone during operation comprising feeding coal and oxygen to the gasification zone for partial oxidation of the coal therein, establishing a pattern or profile of the steam density values at a first locus in said heat exchange zone near the outlet of said gasification zone and at a second locus in said heat exchange zone, said second locus being further displaced in said heat exchange zone from said gasification zone than the first locus;

determining the steam density value at said first locus in said heat exchange zone near the outlet of said gasification zone, concurrently determining the steam density value at said second locus in said heat exchange zone, said second locus being further displaced in said heat exchange zone from said gasification zone than the first locus; and comparing the values obtained concurrently with each other to determine correlated slag deposition events.

10. The process of claim 9 wherein, in response to prolonged increased steam density values at the first locus with concurrent large decrease of the steam density values at the second locus, the process for the partial oxidation of coal in the gasification zone is discontinued.

* * * * *